US012637320B2

(12) United States Patent
Fameree et al.

(10) Patent No.: US 12,637,320 B2
(45) Date of Patent: May 26, 2026

(54) FLUID DELIVERY SYSTEM FOR INTERFOLDING APPARATUS

(71) Applicant: BW Converting, Inc., Green Bay, WI (US)

(72) Inventors: Dwight Fameree, De Pere, WI (US); Jamie Heroux, Gillett, WI (US); Eric Jensen, De Pere, WI (US)

(73) Assignee: BW Converting, Inc., Green Bay, WI (US)

( * ) Notice: Subject to any disclaimer, the term of this patent is extended or adjusted under 35 U.S.C. 154(b) by 0 days.

(21) Appl. No.: 19/211,639

(22) Filed: May 19, 2025

(65) Prior Publication Data

US 2026/0084921 A1 Mar. 26, 2026

Related U.S. Application Data

(63) Continuation-in-part of application No. 18/482,112, filed on Oct. 6, 2023, now Pat. No. 12,319,533.

(60) Provisional application No. 63/417,349, filed on Oct. 19, 2022.

(51) Int. Cl.

| | |
|---|---|
| ***B65H 45/16*** | (2006.01) |
| ***B65H 45/101*** | (2006.01) |
| ***B65H 45/18*** | (2006.01) |
| ***B65H 45/24*** | (2006.01) |

(52) U.S. Cl.

CPC ..... *B65H 45/16* (2013.01); *B65H 45/18* (2013.01); *B65H 45/24* (2013.01); *B65H 2301/452* (2013.01); *B65H 2301/5114* (2013.01)

(58) Field of Classification Search

None

See application file for complete search history.

(56) References Cited

U.S. PATENT DOCUMENTS

| | | | | |
|---|---|---|---|---|
| 4,778,441 | A * | 10/1988 | Couturier | B65H 45/24 493/425 |
| 4,917,665 | A * | 4/1990 | Couturier | B65H 45/24 493/359 |
| 5,000,729 | A * | 3/1991 | Yamauchi | B65H 45/16 493/359 |
| 8,282,090 | B2 * | 10/2012 | Walsh | B65H 33/02 270/39.02 |
| 8,696,537 | B2 * | 4/2014 | Cline | B65H 45/24 270/39.06 |
| 2005/0070419 | A1 * | 3/2005 | Haasl | B65H 29/6618 493/435 |

(Continued)

*Primary Examiner* — Tanzim Imam

(74) *Attorney, Agent, or Firm* — Thompson Coburn LLP

(57) ABSTRACT

An apparatus forms stacks of interfolded sheets. First and second folding rolls receive the plurality of sheets, move the plurality of sheets through the nip, and fold the plurality of sheets into a stack of interfolded sheets downstream of the nip. A packing finger is associated with each folding roll, and the respective packing fingers move between a retracted position and an extended position relative to the corresponding folding roll with alternate movement relative to each other between the retracted position and the extended position to engage the plurality of sheets and form the stack of interfolded sheets. A liquid delivery system delivers liquid to a sheet in the plurality of sheets when the sheet is on one of the folding rolls and before the sheet is moved to the stack.

13 Claims, 10 Drawing Sheets

(56) References Cited

U.S. PATENT DOCUMENTS

| | | | | |
|---|---|---|---|---|
| 2007/0082800 | A1* | 4/2007 | Kauppila | B65H 45/162 493/427 |
| 2010/0261594 | A1* | 10/2010 | Michler | B65H 45/164 493/428 |
| 2022/0127103 | A1* | 4/2022 | Lombardi | B65H 45/28 |

* cited by examiner

FLUID DELIVERY SYSTEM FOR INTERFOLDING APPARATUS

RELATED APPLICATION DATA

This application is a continuation-in-part application of U.S. application Ser. No. 18/482,112, filed Oct. 6, 2023, currently pending, which claims priority benefit to U.S. provisional application Ser. No. 63/417,349, filed Oct. 19, 2022, the disclosures both of which are incorporated by reference herein.

BACKGROUND AND SUMMARY

The present disclosure is directed to a fluid delivery system for an interfolding apparatus. The interfolding apparatus includes opposed folding rolls with a packing finger associated with each of the folding rolls. The folding rolls and respective packing fingers cooperate in folding a sheet in a plurality of sheets and forming the folded sheets into a stack of interfolded sheets. In one aspect, the fluid delivery system includes one or more wetting fingers, each of which is configured to spray a fluid onto a sheet of the stack of the interfolded sheets. In another aspect, the fluid delivery system includes one or more packing fingers that are configured to spray a fluid onto a sheet of the stack of interfolded sheets. In another aspect, the fluid delivery system includes the folding roll and the folding roll is configured to apply a fluid onto a sheet of the stack of interfolded sheets at a specific point in the rotation of the folding roll.

DETAILED DESCRIPTION

Figure 1:
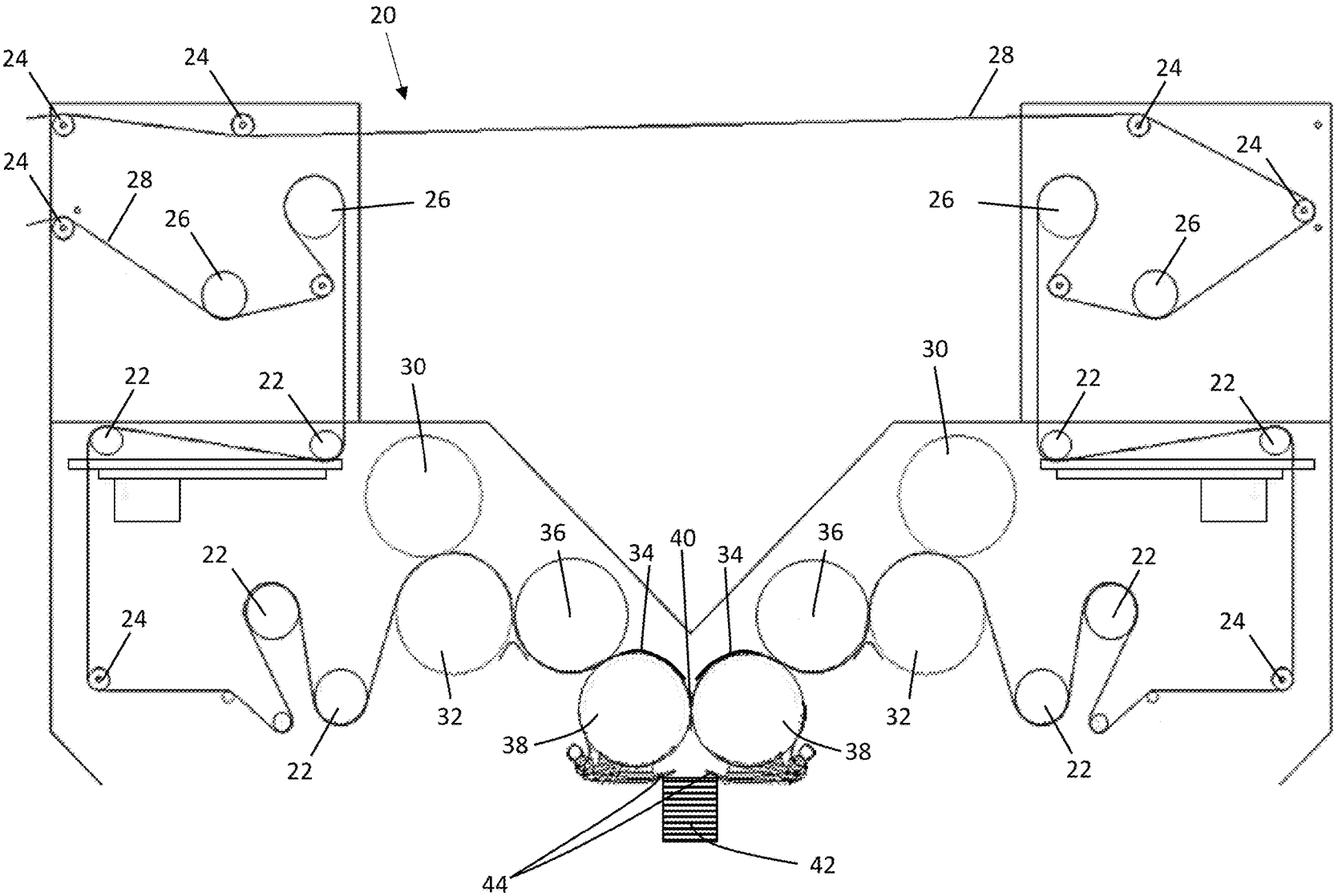
FIG. 1 is schematic drawing showing an interfolding apparatus including the path of a web used to create a sheet of the plurality of sheets to be formed into a stack of interfolded sheets in the interfolding apparatus.

Referring to FIG. 1, the interfolding apparatus 20 includes a plurality of guide rolls 22, idler rolls 24, and driven rolls 26 for feeding one or more webs 28 of material to cutting rolls, for instance, a knife roll 30 and an anvil roll 32, where the web of material is cut into sheets 34. After being cut, the sheets move on to corresponding prefold or lap rolls 36 and folding rolls 38. The folding rolls 38 are opposed to each other and form a nip 40. The folding rolls 38 receive the cut sheets 34 of web material from the cutting rolls 30,32 and prefold rolls 36, and form the sheets into a stack 42 downstream of the nip 40. One or more packing fingers 44 may be associated with each of the folding rolls 38. The packing finger 44 is movable between a retracted position and an extended position relative to its respective folding roll 38. Depending upon the configuration of the interfolding apparatus 20, the packing finger 44 may be disposed in a circumferential groove 46 formed in the folding roll 38. The packing finger 44 associated with one folding roll 38 moves between extended and retracted positions alternating with the movement between extended and retracted positions of the packing finger associated with the other folding roll. The packing finger 44 pushes the sheet 34 from the folding roll 38 to a position where the fold can be pressed with leading and trailing edges of the opposing sheets being folded therebetween. The process continues alternately with the other folding roll to form the stack of material 42.

When producing a product comprising sheets 34 with moisture, for instance, a lotion or a cleaning solution added to the sheet, a fluid delivery system 50 may be aligned to apply a fluid 52 onto the sheet 34 downstream of the nip 40 and downstream of the folding rolls 38 as the sheet is being folded and as the sheet is being placed into the stack 42. In conventional systems, the fluid is applied to the web before the web is introduced to the folding rolls. By delivering moisture onto the sheet 34 at or after the folding rolls 38 before the sheet is folded and placed into the stack 42, the fluid 52 may be more effectively applied onto the sheet thereby reducing fluid loss. Additionally, by delivering moisture onto the sheet 34 at or after the folding rolls 38 before the sheet is folded and placed into the stack 42, a more localized area may be exposed to the fluid 52, which may reduce cleaning and wash down removal of fluid from the interfolding apparatus between production runs, and which may, in a machine which uses vacuum, reduce the extent to which the vacuum system is contaminated with fluid. Further, applying the fluid to the sheet 34 at the end of the process when the sheet is being formed into the stack 42 allows a dry web 28 to be directed through the converting line. The dry web has higher relative strength in comparison to a wet web which facilitates processing in the converting line. Further, by being able to process a dry web 28, a lower strength web substrate may be used, for example a dispersible substrate.

Figure 2:
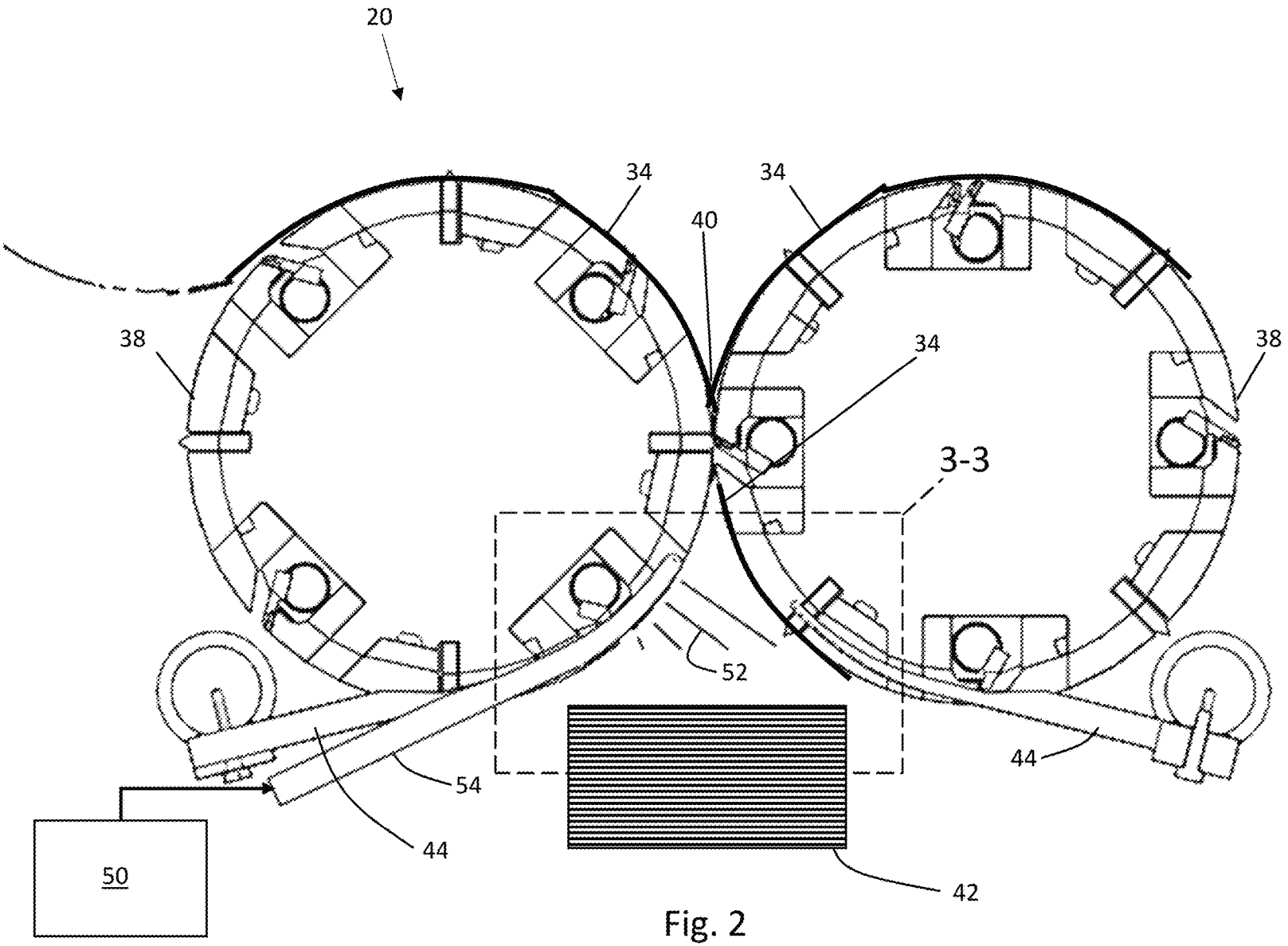
FIG. 2 is an enlarged detail view of the interfolding apparatus including first and second folding rolls, packing fingers associated with each of the folding rolls, and a wetting finger for delivering fluid from the fluid delivery system and spraying a sheet in the plurality of interfolded sheets in a stack.
Figure 3:
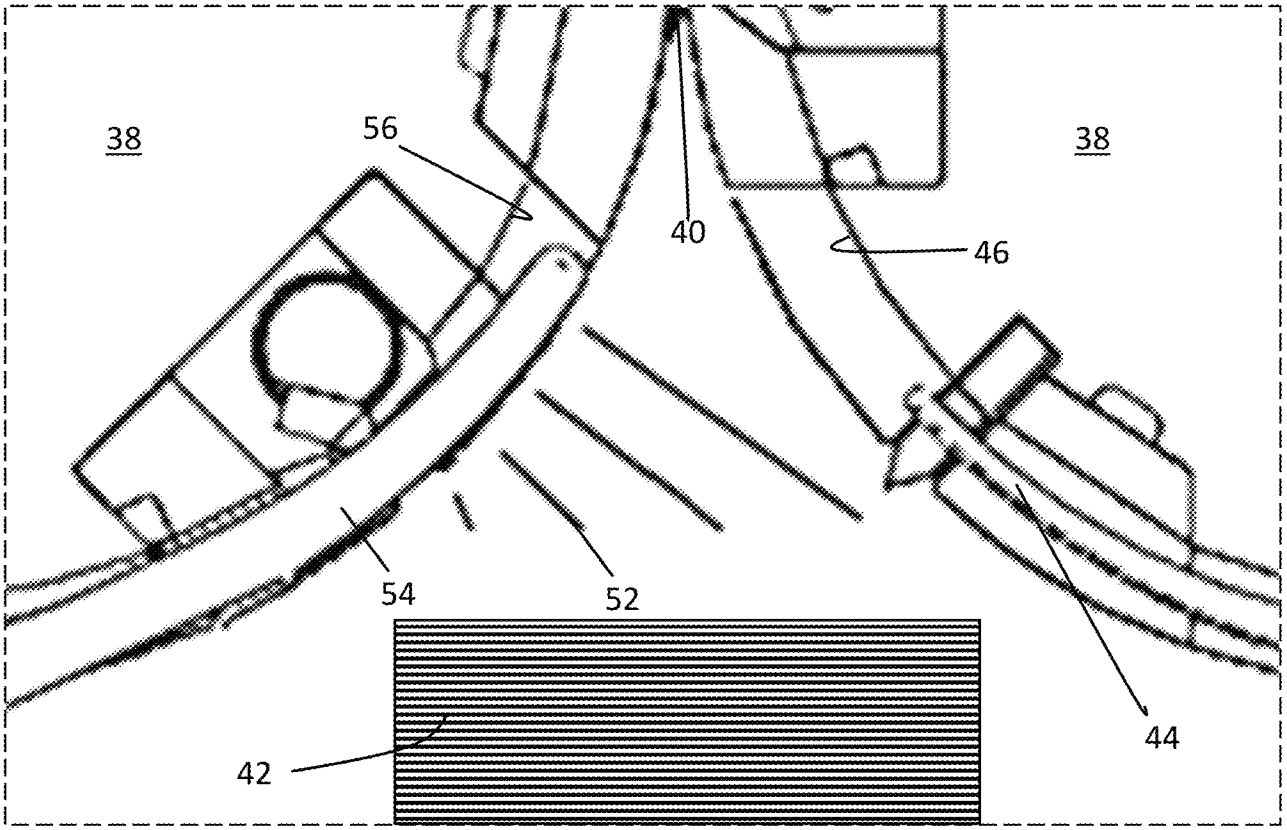
FIG. 3 is a further enlarged view of the wetting finger and packing finger apparatus from detail area 3-3 of FIG. 2.
Figure 4:
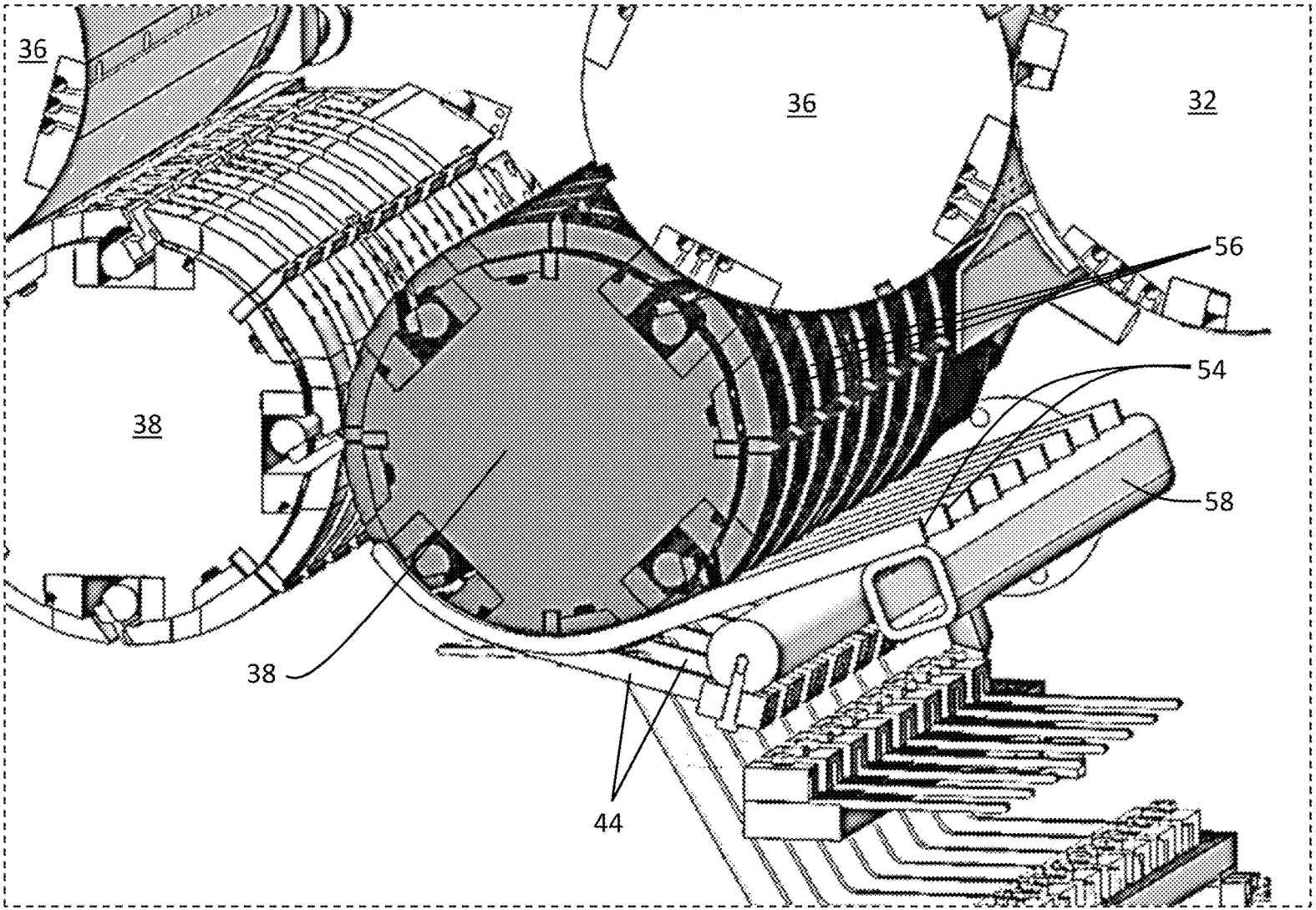
FIG. 4 is a partial, perspective view of the interfolding apparatus showing a plurality of wetting fingers disposed in circumstantial grooves of one of the folding rolls.
Figure 5:
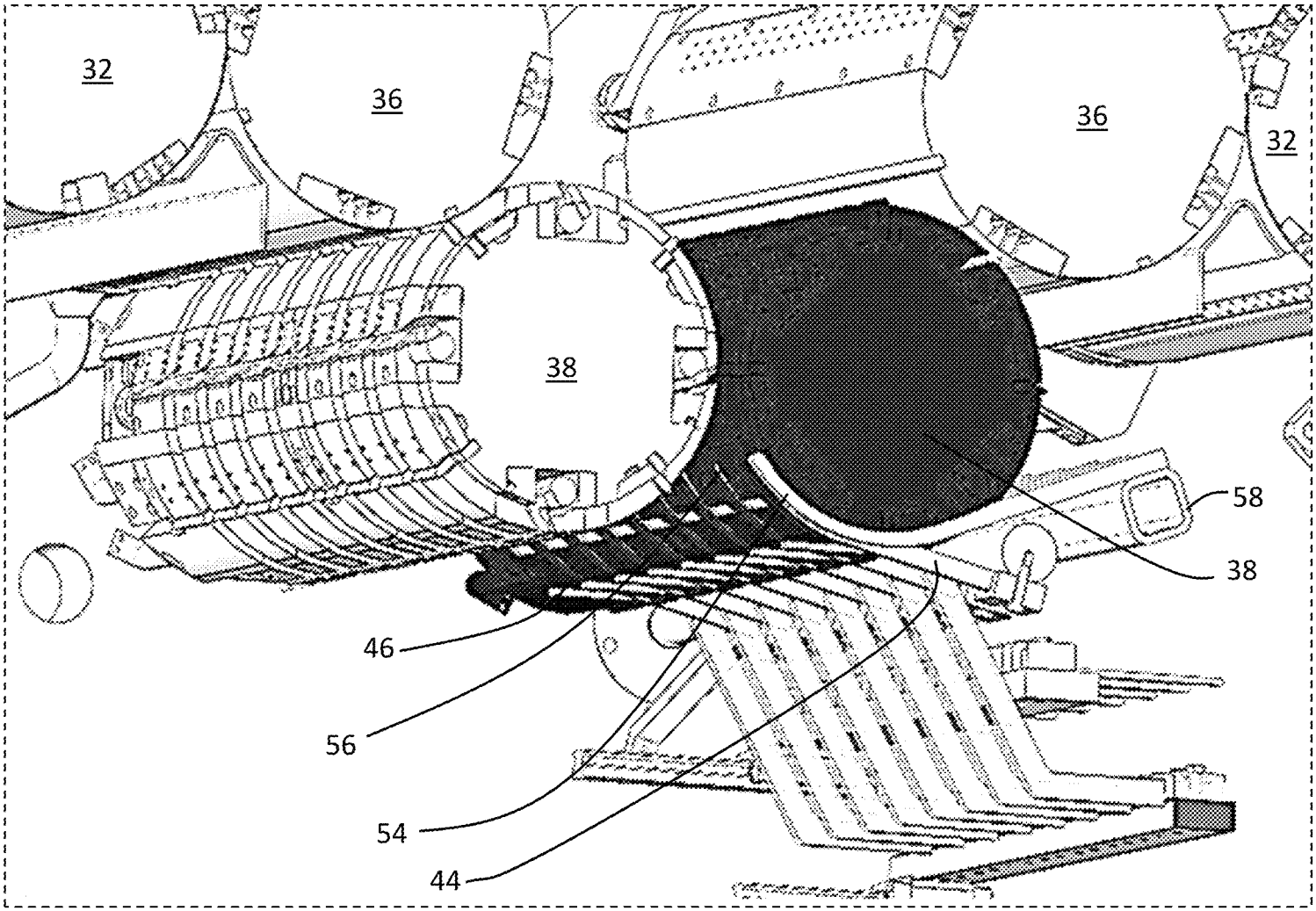
FIG. 5 is another partial, perspective view of the interfolding apparatus showing the plurality of wetting fingers disposed in the circumferential grooves of the folding roll and showing the packing fingers disposed in the same circumferential grooves and being interdigitated with the wetting fingers.

Making reference to FIG. 2, in one aspect of the interfolding apparatus 20, the fluid delivery system 50 includes a wetting finger 54. The wetting finger 54 may be associated with one of the folding rolls 38. There may be a wetting finger 54 associated with the first folding roll and a further wetting finger associated with the second folding roll. The wetting finger 54 may be one of a plurality of wetting fingers that is associated with a respective folding roll 38. The wetting finger 54 may be stationary relative to the folding roll 38. The wetting finger 54 may be disposed in a circumferential groove 56 of the folding roll. In an arrangement involving multiple wetting fingers such as that shown in FIGS. 4 and 5, a plurality of wetting fingers may be disposed in a plurality of circumferential grooves 56 formed on the folding roll 38. The fluid delivery system 50 may include a manifold 58 for delivering fluid 52 to each of the wetting fingers 54. The wetting finger 54 may occupy the same circumferential groove (46,56) as the packing finger 44 that is associated with the folding roll 38. The wetting finger 44 has one or more fluid outlets 60 configured to apply fluid 52 onto the sheet 34 as the sheet passes through the nip 40 downstream of the folding rolls 38. The wetting finger 54 may deliver fluid 52 onto the sheet 34 before it is formed into the stack 42 or the wetting finger may deliver fluid directly onto the stack. The application of fluid 52 via the fluid delivery system 50 may be intermittent or continuous. While FIGS. 4 and 5 show the plurality of wetting fingers associated with one roll, a similar system of a plurality of wetting fingers and a manifold may be arranged on the opposite folding roll. Alternatively, the fluid 52 could be applied to the sheet on the side opposite of the folding roll 38 via other mechanisms. An example may include spray nozzles. An example may include a non-contact slot coater.

Figure 6:
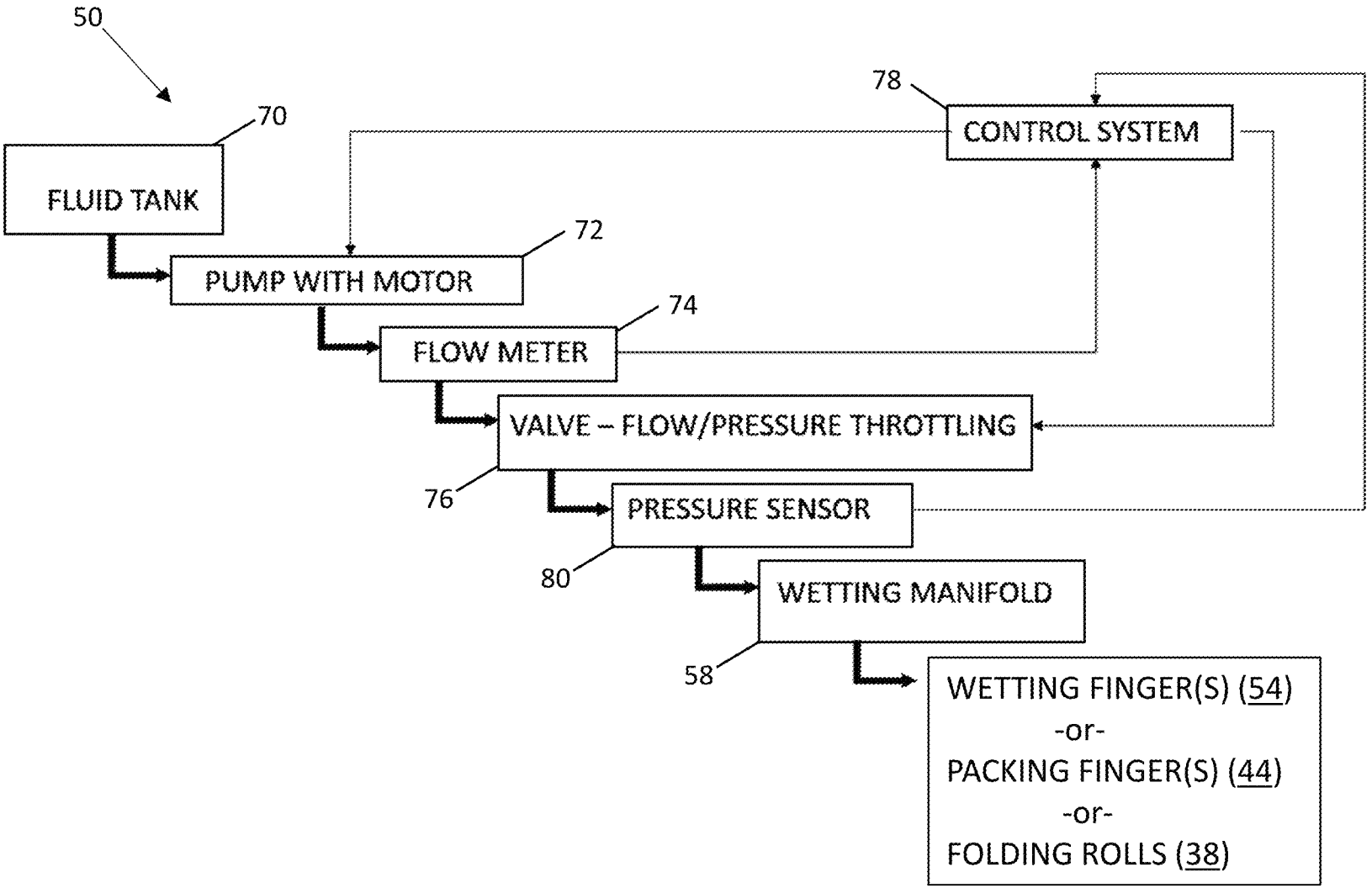
FIG. 6 is a schematic diagram showing the components of the fluid delivery system.

As shown in FIG. 6, the fluid delivery system includes a fluid tank 70 for storing the fluid to be applied to the sheets 34 in the stack 42. The fluid may be drawn from the tank 70 with a motorized pump 72. The discharge of the pump may include a flow meter 74 and a valve 76 for regulating the flow and pressure of the fluid 52 being delivered through the fluid delivery system 50. A control system 78 may receive inputs from a pressure sensor 80 downstream of the pump 72 and control the pump 72 and/or the valve 76 to maintain flow and pressure within desired parameters. In the arrangement involving multiple wetting fingers 54, the fluid 52 may be delivered to the manifold 58 and subsequently to the wetting fingers, or in the embodiments described below to the packing finger 44 or the folding roll 38.

Figure 7:
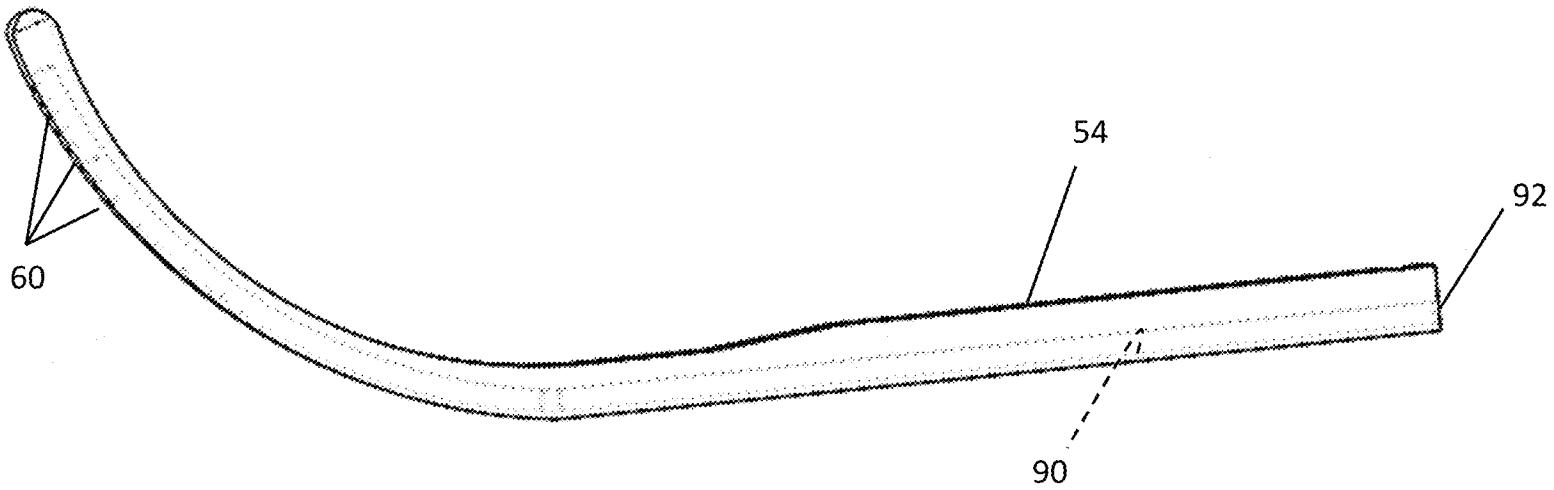
FIG. 7 is a perspective view of a wetting finger.
Figure 8:
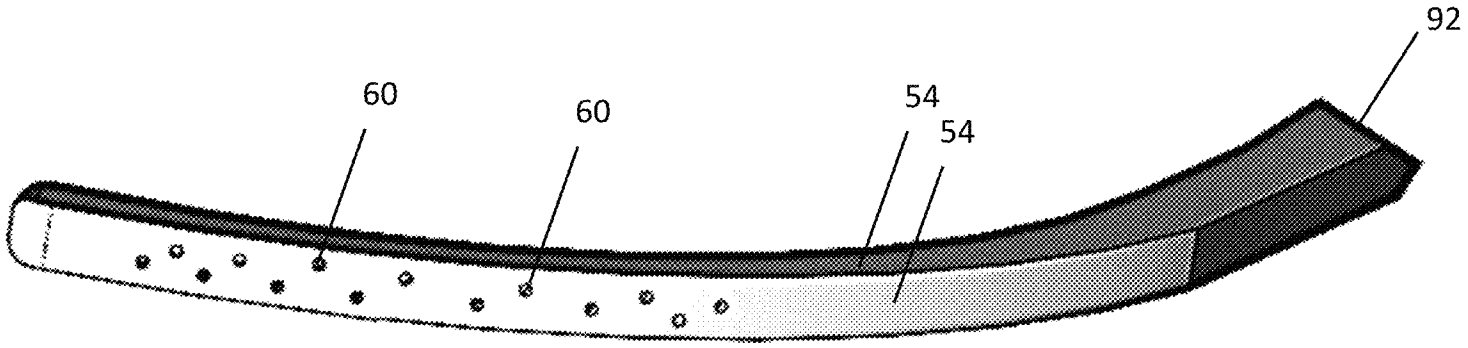
FIG. 8 is another perspective view of a wetting finger.

FIGS. 7 and 8 provide additional detail of the wetting finger 54. The wetting finger 54 has a generally hollow interior 90 which forms a delivery tube or conduit. The fluid 52 flows from a fluid inlet 90 to a plurality of outlets 60 that are provided on the wetting finger. The fluid outlets 60 may be formed as nozzles and spaced along the finger to provide necessary spray coverage. The wetting finger 54 may be shaped to generally conform to the folding rolls 38 and to deliver the fluid 52 to the sheet 34 downstream of the nip 40 and the folding rolls 38.

Figure 9:
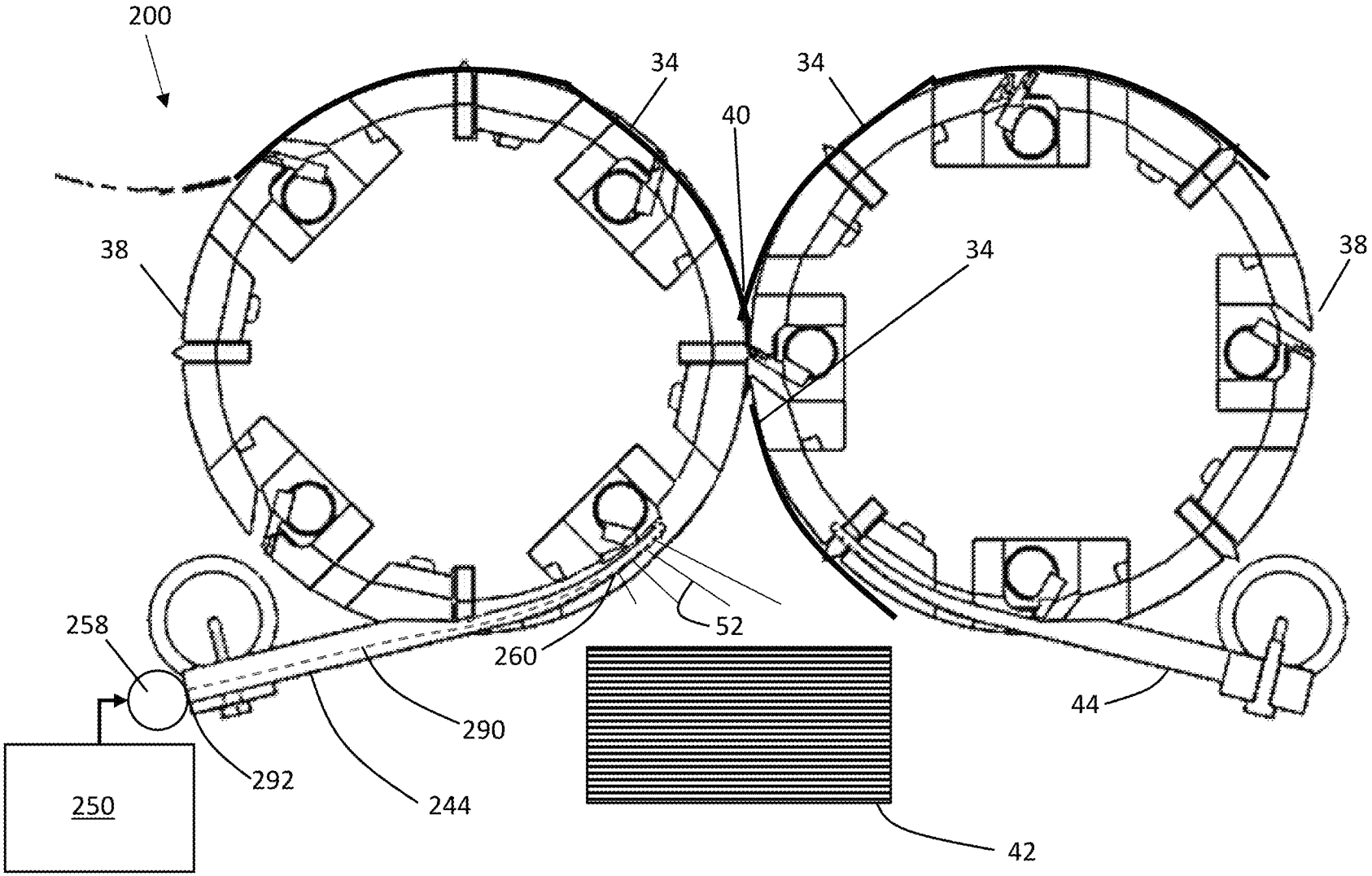
FIG. 9 is an enlarged view of an alternative embodiment of the interfolding apparatus showing a packing finger that is in fluid communication with the fluid delivery system for spraying a fluid onto a sheet of the plurality of interfolded sheets forming the stack.

FIG. 9 shows an alternate embodiment of the interfolding apparatus 200 and fluid delivery system 250 where the packing finger 244 is in fluid communication with the fluid delivery system. Although the packing finger 244 oscillates between extended and retracted positions, the packing finger 244 may include an internal conduit 290 and fluid inlet 292 that receives fluid, for instance, from a manifold 258 of the type shown in FIGS. 4 and 5, and delivers fluid to the sheet via fluid outlets 260 formed along the length of the packing finger similar to the wetting finger of FIGS. 7 and 8. The packing finger 244 may be one in a plurality of packing fingers associated with a folding roll 38.

Figure 10:
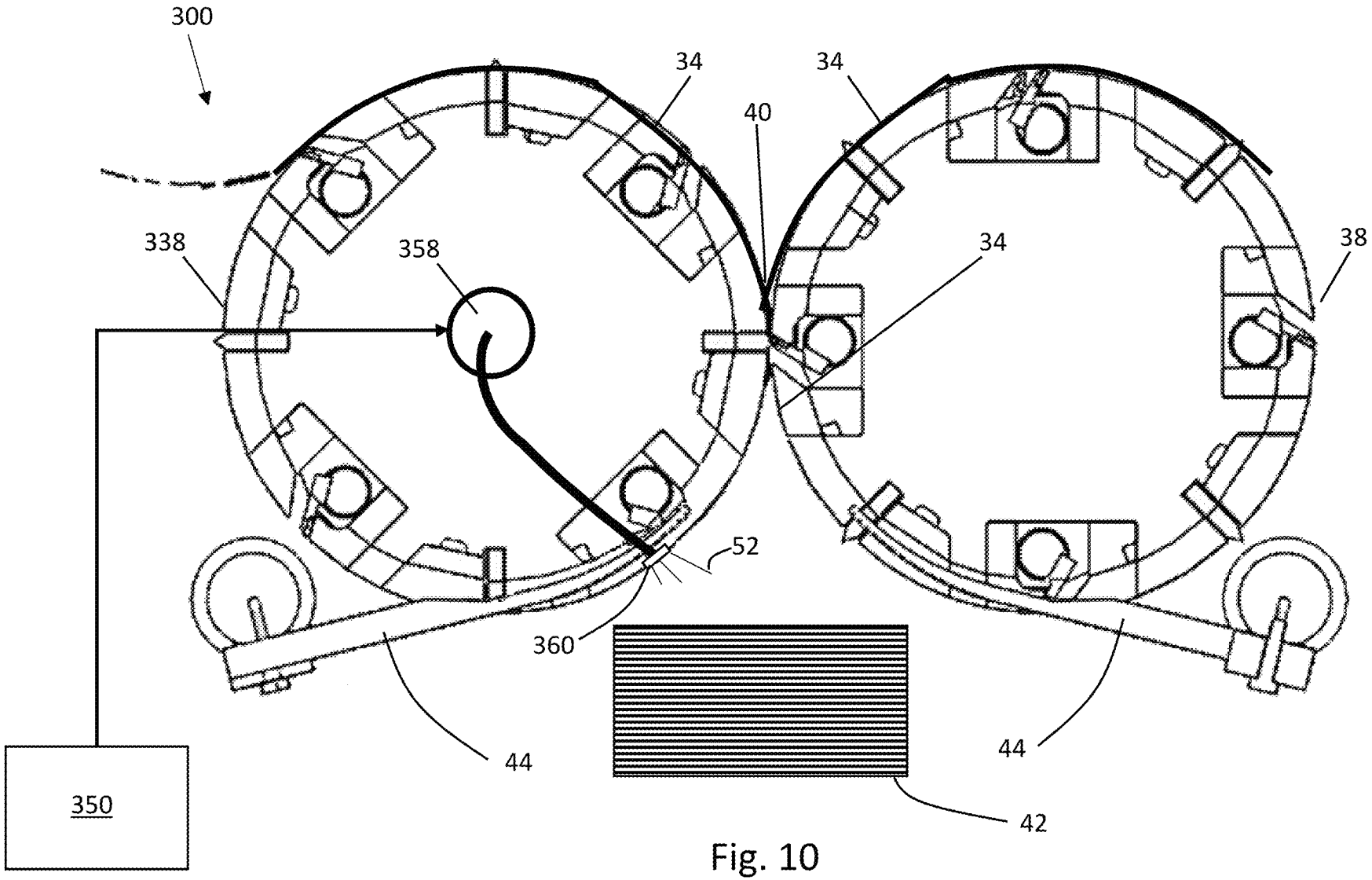
FIG. 10 is an enlarged view of another alternate embodiment of the interfolding device apparatus showing a folding roll that is in fluid communication with the fluid delivery system for spraying a fluid onto a sheet of the plurality of interfolded sheets forming the stack.

FIG. 10 shows a further alternate embodiment of the interfolding apparatus 300 and fluid delivery system 350 where at least one of the folding rolls 338 is in fluid communication with the fluid delivery system. The folding roll 338 may have an internal conduit 358 that communicates with a fluid outlet 360 formed on the outer surface of the folding roll 338. The internal conduit 358 may be in fluid communication with a manifold associated with the fluid delivery system. The fluid outlet 360 on the outer surface of the folding roll 338 may be adapted to spray the fluid 52 onto the stack 42 or a sheet 34 before it is placed on the stack at a specific point of rotation of the folding roll 338.

Figure 11:
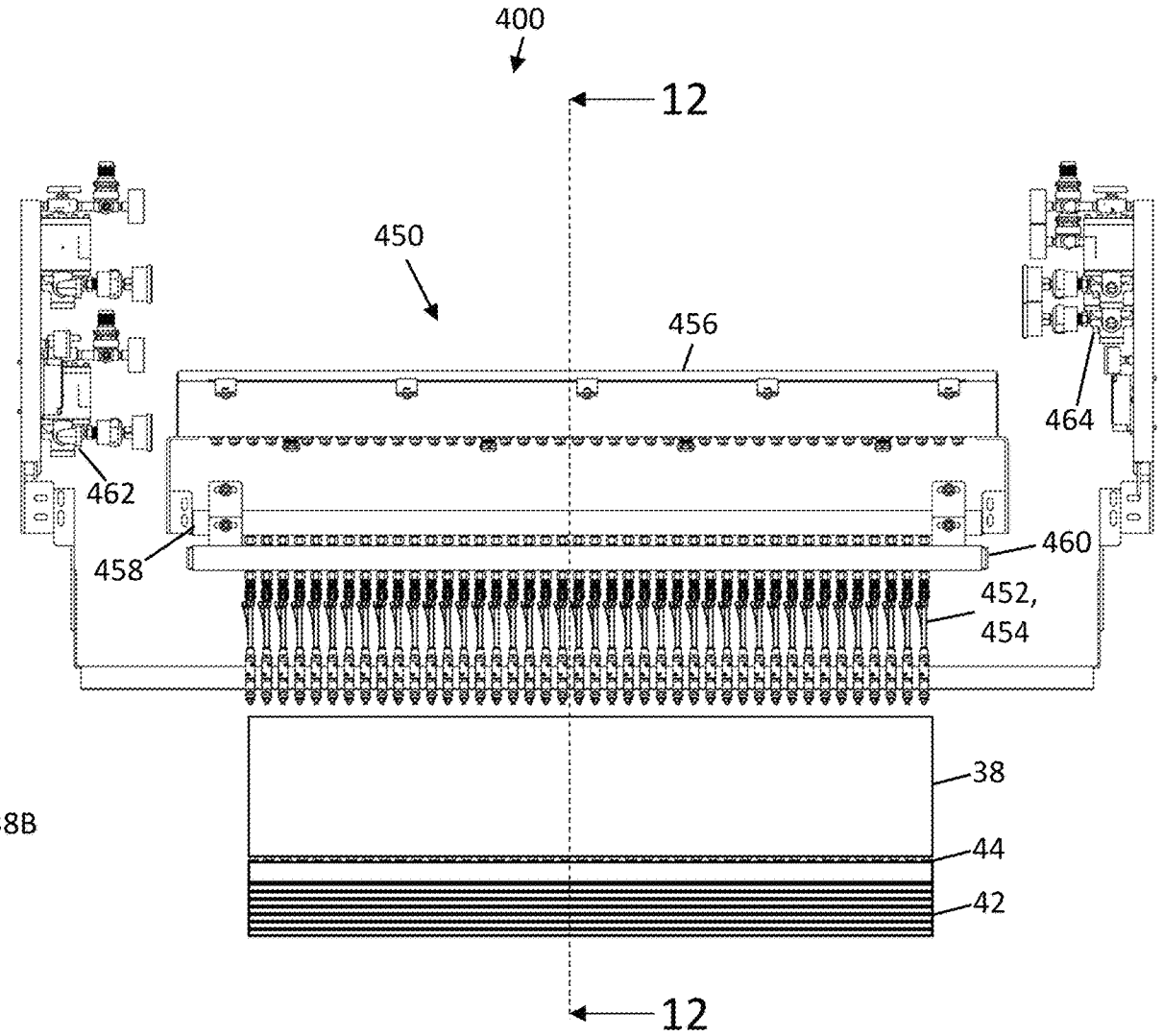
FIG. 11 is an enlarged view of another alternate embodiment of the interfolding device apparatus showing a fluid delivery system for spraying a fluid onto a sheet of the plurality of interfolded sheets forming the stack at the folding rolls.
Figure 12:
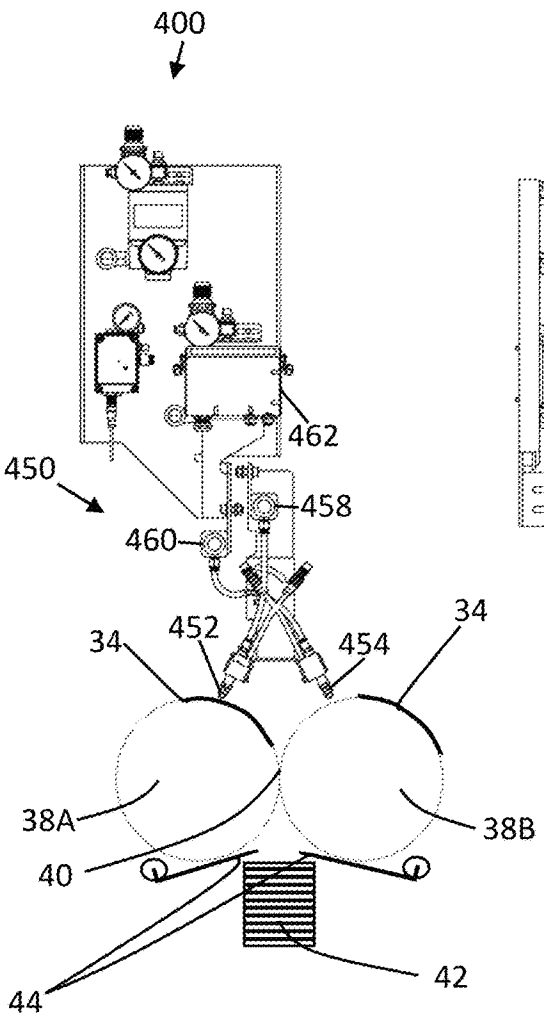
FIG. 12 is a side view of the interfolding device apparatus of FIG. 11 taken through section line 12-12 of FIG. 11.

FIGS. 11-12 shows a further alternate embodiment of the interfolding apparatus 400 and a fluid delivery system 450. The fluid delivery system 450 of FIGS. 11-12 is configured to apply the fluid to the sheet 34 before the sheet is placed on the stack 42 with the fingers 44, and at a specific point of rotation of the sheet on the corresponding folding roll 38A,38B. The fluid delivery system 450 comprises a plurality of nozzles 452,454, which may be supported by brackets 456 extending in the cross machine direction above the nip 40 formed by the folding rolls 38A,38B. The plurality of nozzles 452,454 may be arranged as a first set of nozzles and a second set of nozzles with each set of nozzles being in communication with a respective manifold 458,460 supported by the brackets 456. One manifold 458 may be supplied from a fluid control system 462 on one side of the interfolding apparatus, and the other manifold 460 may be supplied from fluid control system 464 on the opposite side of the interfolding apparatus. The fluid control systems 462,464 may be configured to provide a measured amount of pressurized fluid into the respective manifolds 458,460 and to the nozzle sets 452,454. The first set of nozzles 452 in the plurality of nozzles is aimed at one folding roll 38A and a second set of nozzles 454 in the plurality of nozzles is aimed at the other folding roll 38B. The fluid control system 462 associated with the manifold 458 of the first set of nozzles 452 (and thus the first folding roll 38A) may be configured to deliver fluid to the first nozzle set 452 as a sheet 34 rotates on the first folding roll 38A, and in one particular aspect, as a leading edge of the sheet enters the spray pattern from the nozzles 452 and to deactivate once a trailing edge of the sheet exits the spray pattern from the nozzles. Likewise, the fluid control system 464 associated with the manifold 460 of the second set of nozzles 454 (and thus the second folding roll 38B) may be configured to deliver fluid to the second nozzle set 454 as a sheet rotates 34 on the second folding roll 38B, and in one particular aspect, as a leading edge of the sheet enters the spray pattern from the nozzles, and to deactivate once a trailing edge of the sheet exits the spray pattern from the nozzles. The fluid control systems 462,464 associated with the respective manifolds 458,460 may operate in a timed sequence corresponding to the timing and sequencing of the interfolding apparatus delivering a sheet 34 to a respective folding roll 38A,38B. In other words, the fluid control systems 462,464 associated with the respective manifolds 458,460 may each operate in an intermittent pattern, i.e., "on" when the sheet 34 is in position on its corresponding folding roll to receive the fluid, and "off" when another sheet is in position on the other folding roll to receive the fluid. Each fluid control system 462,464 may be in operative communication with a control of the interfolder so as to deliver fluid to the sheet when the sheet is in a position on the corresponding folding roll to receive the fluid. Each folding roll may have a speed sensor that provides a signal to the control and on to the fluid control systems 462,464 to allow the delivery of the fluid to the sheet when the sheet is in position on the corresponding folding roll to receive the fluid. An encoder associated with the folding roll may provide position signals to the control and on to the fluid control systems 462,464 to allow the delivery of the fluid to the sheet when the sheet is in position on the corresponding folding roll to receive the fluid. Optical sensors associated with the folding roll may provide signals (e.g., position or visual signals) to the control and on to the fluid control systems 462,464 to allow delivery of the fluid to the sheet when the sheet is in position on the corresponding folding roll to receive the fluid. The fluid control systems 462,464 may also be programmed without a central control to deliver fluid at selectable or prescribed time intervals based on the speed of the folding rolls which may be with or without regard to the exact position of the sheet on the corresponding folding roll.

A combination of one or more of the aforementioned folding rolls, spray nozzles, wetting fingers and packing fingers may be used in the fluid delivery system to deliver fluid onto a sheet and/or the stack of sheets at or after the folding rolls. One or more of the aforementioned folding rolls, spray nozzles, wetting fingers and packing fingers in combination with the fluid delivery system may be installed as original equipment on the interfolding apparatus or provided via retrofit to an existing interfolding apparatus. Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

The invention claimed is:

1. An apparatus for forming stacks of interfolded sheets from a plurality of sheets, the apparatus comprising:

first and second folding rolls being opposed to one another to form a nip, the first and second folding rolls being configured to receive the plurality of sheets, move the plurality of sheets through the nip, and fold the plurality of sheets into a stack of interfolded sheets downstream of the nip;

a first packing finger associated with the first folding roll;

a second packing finger associated with the second folding roll, the first packing finger being adapted and configured to move between a retracted position and an extended position relative to the first folding roll, the second packing finger being adapted and configured to move between a retracted position and an extended position relative to the second folding roll, and the first and second packing fingers being adapted and configured to alternate movement relative to each other between the retracted position and the extended position to engage the plurality of sheets and form the stack of interfolded sheets; and a liquid delivery system adapted and configured to deliver a liquid to a sheet of the plurality of sheets when the sheet is on one of the folding rolls and before the sheet is moved to the stack.

2. The apparatus of claim 1 wherein the liquid delivery system comprises a plurality of nozzles aimed at the one of the folding rolls.

3. The apparatus of claim 1 wherein the liquid delivery system comprises a first set of nozzles aimed at the one of the folding rolls and a second set of nozzles aimed at the other of the folding rolls.

4. The apparatus of claim 3 wherein the first set of nozzles is in communication with a first liquid control system.

5. The apparatus of claim 4 wherein the first liquid control system is configured to deliver the liquid to the sheet as a leading edge of the sheet enters a spray pattern from the first set of nozzles and to deactivate once a trailing edge of the sheet exits the spray pattern from the first set of nozzles.

6. The apparatus of claim 4 wherein the first set of nozzles is supplied with the liquid from the first liquid control system via a first manifold.

7. The apparatus of claim 4 wherein the first liquid control system is configured to deliver the liquid when the sheet is on the one of the folding rolls.

8. The apparatus of claim 4 wherein the first liquid control system is configured to deliver the liquid intermittently.

9. The apparatus of claim 4 wherein the second set of nozzles is in communication with a second liquid control system.

10. The apparatus of claim 9 wherein the second liquid control system is configured to deliver the liquid to the sheet as a leading edge of the sheet enter a spray pattern from the second set of nozzles and to deactivate once a trailing edge of the sheet exits the spray pattern from the second set of nozzles.

11. The apparatus of claim 9 wherein the second set of nozzles is supplied with the liquid from the second liquid control system via a manifold.

12. The apparatus of claim 9 wherein the second liquid control system is configured to deliver the liquid when the sheet is on the other of the folding rolls.

13. The apparatus of claim 9 wherein the second liquid control system is configured to deliver the liquid intermittently.

* * * * *